United States Patent [19]

Bourlier et al.

[11] 4,303,021

[45] Dec. 1, 1981

[54] MONEY PASSING DEVICE IN PARTICULAR FOR BANKS, STATIONS OR DEPARTMENTAL STORES

[76] Inventors: Claude P. Bourlier, 3 rue J.F. Belbeoch, 94410 Saint Maurice; Louis E. Sallot, 9 rue du General Leclerc, 92270 Bois Colombes, both of France

[21] Appl. No.: 120,942

[22] Filed: Feb. 12, 1980

[30] Foreign Application Priority Data

Feb. 16, 1979 [FR] France ..... 79 03961

[51] Int. Cl.[3] ..... E05G 7/00; E06B 9/00

[52] U.S. Cl. ..... 109/19; 109/10

[58] Field of Search ..... 109/19, 10, 11

[56] References Cited

U.S. PATENT DOCUMENTS

| | | | |
|---|---|---|---|
| 1,264,051 | 4/1918 | Fullerton | 109/19 |
| 1,890,587 | 12/1932 | Plym | 109/19 |
| 4,069,773 | 1/1978 | Clark | 109/19 |

*Primary Examiner*—Reinaldo P. Machado
*Attorney, Agent, or Firm*—James C. Wray

[57] ABSTRACT

The money passing device is adapted to equip counters having windows and is of the type comprising a bowl inserted in the counter and fictitiously divided into two parts by the extension of a partition wall separating the official from the public.

The device comprises a shutter whose dimensions are very slightly less than those of the upper side of the bowl. The shutter is freely pivotable about an axis which coincides with the median plane of the partition wall. The axis is located slightly above the bowl so that, in its horizontal position, the shutter covers the bowl. End-of-travel abutments are provided for limiting the angular movements of the shutter in which the latter alternately uncovers one of the two parts of the bowl while it closes the other opposite part.

This device has its application in any counters or counter windows and can be used for passing money, documents or other objects.

9 Claims, 1 Drawing Figure

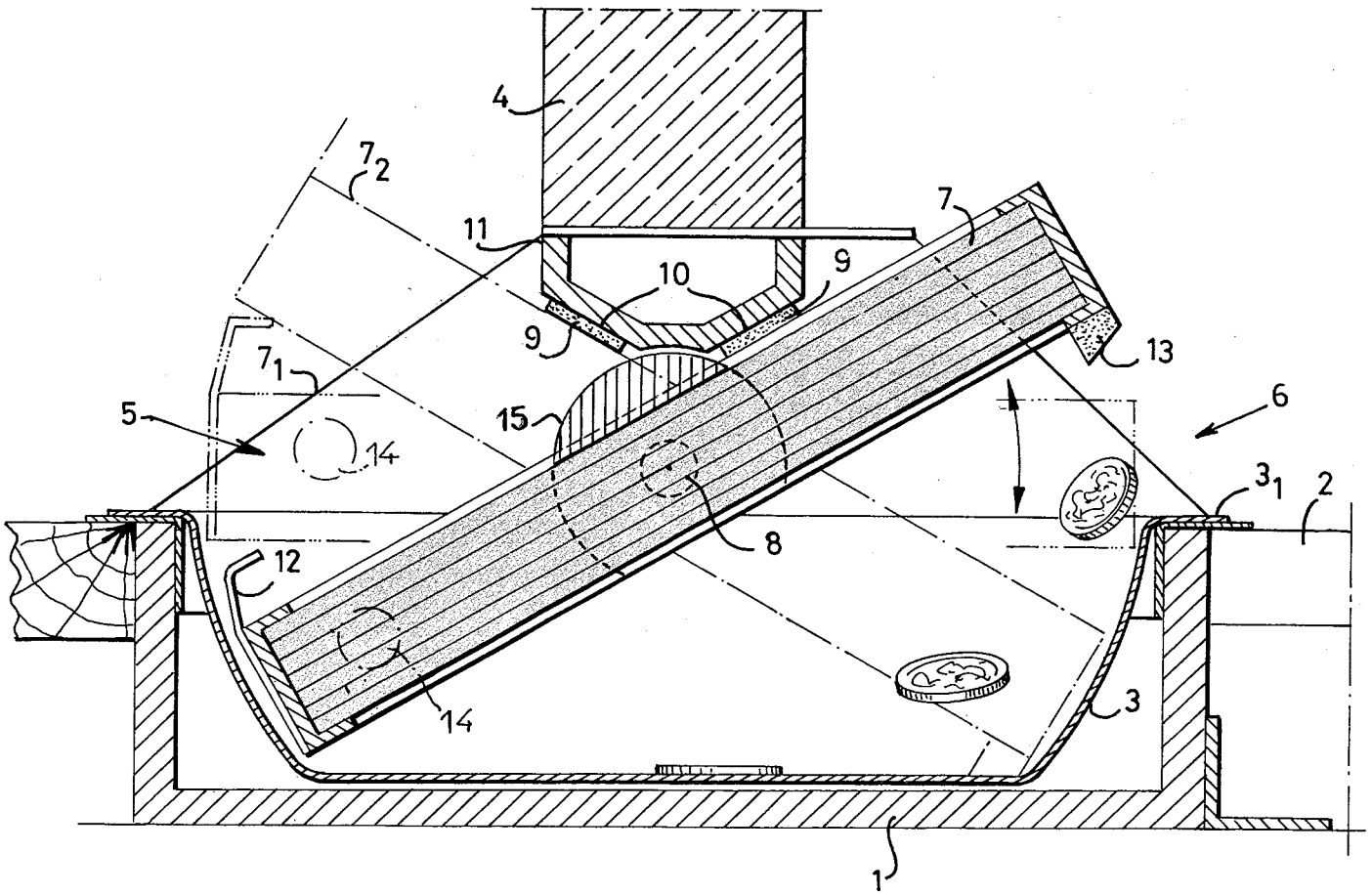
1
2
3
3₁
4
5
6
7
7₁
7₂
8
9
9
10
11
12
13
14
14
15

MONEY PASSING DEVICE IN PARTICULAR FOR BANKS, STATIONS OR DEPARTMENTAL STORES

The invention relates to a money passing device for counters having windows, for example those of banks, stations, departmental stores, and other administrative organizations or public services at the disposal of the users.

Money passing devices of this type are well known and usually comprise, as mentioned in French Pat. No. 76 10 453 of Apr. 9, 1976 owned by the firm Societe HYGIAPHONE, a box structure inserted in the counter and supporting a bowl which is fictitiously divided into two parts by the wall separating the official from the public, this wall being moreover usually made from bullet-proof glass. As this type of money passing device is designed for exchanges effected in complete safety for the official, it is usual to cover the bowl with shutters which are moved in translation and in rotation so as to alternately mask and uncover each of the two sides of the bowl located on each side of the wall isolating the official from the public, the exchanges thus occurring within the framework of a complete physical sealing off which precludes, in particular, the passage of an arm.

Although these devices as a rule satisfy the safety requirements of the regulations in force, they have the drawbacks of being expensive to make, owing in particular to the mechanism controlling the shutters, and fastidious to handle.

Consequently, an object of the invention is to overcome the drawbacks and provides for this purpose a money passing device adapted to equip counters having windows and of the type comprising a bowl inserted in the counter and fictitiously divided into two parts by the extension of the wall separating the official from the public, wherein there is provided a shutter having dimensions which are very slightly less than those of the upper side of the bowl said shutter being freely pivotable about an axis which coincides with the median plane of the separating wall, said axis being located slightly above the bowl so that the shutter covers the bowl when in a horizontal position, end-of-travel abutments being provided for limiting the angular movements of the shutter whereby the shutter uncovers alternately one of the two parts of the bowl and masks the opposite other part.

In an advantageous embodiment, the pivotal shutter is made from a bullet-proof material and slightly penetrates the bowl when it is in its horizontal position so that the raising thereof for uncovering one part of the bowl immediately corresponds to the closing of the opposite part.

According to one feature of the invention, the end-of-travel abutments limiting the angular movements of the pivotal shutter are in the form of shock-absorbing pads which are fixed to opposite sides of a flat-sided section member which forms the base of the partition wall.

A money passing device according to the invention is shown merely by way of example in the accompanying single FIGURE which is a longitudinal sectional view of the device.

This money passing device comprises a box structure 1 inserted in a counter 2, this box structure having a parallel-sided shape and acting as a support for a bowl 3 which is, in the presently described embodiment, in the form of a trough having a flat bottom which is connected to curved walls, the upper edge $3_1$ of which is outwardly formed over so as to marry up with the planar top of the counter 2. This bowl may be made from pressed metal or from a rigid injected plastics material and may have for facilitating the picking up of the money which will be placed in this bowl, channels, grooves or cavities whose function is to centre the money in a given region which facilitates the picking up of this money.

The bowl is virtually divided into two opposite parts by the extension of the partition wall 4 which partitions the official off from the public.

Indeed, this partition wall has for purpose to shelter or protect the official, i.e. the cashier, from offenders and it is for this purpose made from a bullet-proof material such as a high safety glass. This partition wall 4 is located on the transverse median axis of the bowl 3 and thus defined two access regions, namely a region 5 on the official's side and a region 6 on the public side.

According to the invention, these two regions 5 and 6 are alternately closed or uncovered by a pivotable shutter 7 which is mounted to pivot about an axis 8 which is located on the median axis of the bowl and consequently of the partition wall 4. This shutter and the wall 4 are made from a bullet-proof material so as to protect the official or the personnel behind the counter windows when exchanging money.

According to the invention, the pivot axis 8 is located slightly above the bowl so that, when the shutter is in the horizontal position as shown in dot-dash line at $7_1$, this shutter slightly penetrates the interior of the bowl. In this respect, the dimensions of the shutter 7 are slightly less than those of the opening of the bowl and owing to the slight penetration of the shutter in the bowl, a slight raising of the shutter in either direction immediately closes the opposite part of the bowl.

The shutter $7_1$ which is freely pivotable under the effect of its own weight on the axis 8 is limited in this pivotal movement by end-of-travel abutment 9 in the form of shock-absorbing pads, which stop the pivotal shutter in its two extreme positions illustrated in full lines at 7 or in dot-dash line at $7_2$. These abutments 9 are secured to two opposite sides 10 of a flat-sided section member 11 which forms the base of the partition wall 4 separating the official from the public.

The part of the pivotal shutter located on the official's side is provided with a shifting handle 12, which facilitates the handling of the shutter, and in particular the raising thereof, for bringing it from the position illustrated in full lines to the position illustrated in dot-dash lines at $7_2$. On the other hand, the other opposite part of the shutter on the public side is devoid of any handling means or cavity so that the public cannot raise the shutter when it has been brought to the position $7_2$ by the official. The part of the shutter on the public side is provided with an elastic protecting member 13 which extends throughout the length of the lower edge of the shutter so that the client is protected in the event of a clumsy movement on the part of the official when he pivots the shutter.

Further, the shutter may be immobilized by the official in the horizontal position by means of a locking rod which is located on the side wall and enters a lateral orifice 14 provided in the shutter. The shutter with its closing member 15, which has its centre of gravity above its axis of rotation, is in unstable equilibrium in the horizontal position and is stabilized in the position 7 or $7_2$, depending on the direction in which it is pivoted after unlocking.

The money passing device as described herein before has the considerable advantage of being simple to manufacture and above all easy to handle. Being of a construction devoid of any sophisticated or noisy means, it is nonetheless a device which affords considerable safety and is sufficiently transparent so that the exchanges can be carried out in full view. It will be understood that this type of device may be employed for purpose other than the passage of money and may of course used with identical or different dimensions for the passage of documents or objects in administrative organizations, departmental stores, chemist-shops, etc. This device has consequently many applications, owing to its simplicity and ease of handling, wherever an official must be protected from offenders.

We claim:

1. A money passing device comprising a counter, a partition wall partitioning an official off from the public and defining an opening between the partition wall and the top of the counter, a bowl inserted in the counter and fictitiously divided into two parts by an extension of the partition wall, a shutter having dimensions which are slightly less than the dimensions of an upper side of the bowl, the shutter being mounted to be pivotable relative to the partition wall about an axis which substantially coincides with the median plane of the partition wall, said axis being located slightly above the bowl in such position that the shutter covers the bowl and closes said opening in any position of the shutter, end-of-travel abutments co-operative with the shutter for limiting the angular movements of the shutter whereby the shutter uncovers alternately one of said two parts of the bowl while it closes the other opposite part of the bowl.

2. A device as claimed in claim 1, wherein the shutter is made from a bullet-proof material and slightly penetrates the bowl when it is in its horizontal position so that, when it is pivoted in order to uncover one part of the bowl, the opposite part of the bowl is immediately closed.

3. A device as claimed in claim 1, comprising a flat-sided section element forming a base of the partition wall, the end-of-travel abutments limiting the angular movements of the pivotal shutter comprising shock-absorbing pads which are fixed to two opposite sides of the flat-sided section element.

4. A device as claimed in claim 1, wherein a part of the shutter located in the official's side is provided with a shifting handle whereas the opposite other part of the shutter is devoid of holding means and includes a protective elastic member.

5. A device as claimed in claim 1, wherein the bowl comprises means for facilitating the location and the picking up of coins of money.

6. A device as claimed in claim 1, wherein the shutter is provided with a projection extending upwardly to the lower end of the partition wall, said projection having an arcuate outer surface complementary to a surface at said end of the partition wall.

7. A device as claimed in claim 6, wherein the center of gravity of the projection is above said axis thereby rendering the shutter unstable in horizontal position and stable in an angular position.

8. A device as claimed in claim 1, further comprising a rod mounted for selective axial movement relative to the shutter and being received within a lateral opening in the shutter when translated toward the shutter when the shutter is in a horizontal position, thereby locking the shutter in said horizontal position.

9. A device as claimed in claim 1, wherein the bowl has a flat bottom portion and curved sidewall portions.

* * * * *